US006581985B1

(12) United States Patent
Ramsauer

(10) Patent No.: US 6,581,985 B1
(45) Date of Patent: Jun. 24, 2003

(54) LATCH CLOSURE

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/787,691

(22) PCT Filed: Sep. 11, 1999

(86) PCT No.: PCT/EP99/06734

§ 371 (c)(1),
(2), (4) Date: May 25, 2001

(87) PCT Pub. No.: WO00/17472

PCT Pub. Date: May 30, 2000

(30) Foreign Application Priority Data

Sep. 23, 1999 (DE) ..... 298 17 033

(51) Int. Cl.[7] ..... E05C 1/12

(52) U.S. Cl. ..... 292/165; 292/170; 292/173; 292/140; 292/143; 292/336.3; 49/394; 160/118

(58) Field of Search ..... 292/DIG. 31, 165, 292/170, 173, 140, 143, 336.3; 49/394; 160/118

(56) References Cited

U.S. PATENT DOCUMENTS

| | | | | |
|---|---|---|---|---|
| 1,473,076 A | | 11/1923 | Bonilla | |
| 1,512,939 A | | 10/1924 | Ledin | |
| 4,231,597 A | * | 11/1980 | Pelcin | 292/143 |
| 5,039,145 A | * | 8/1991 | Frye | 292/143 |
| 5,522,445 A | * | 6/1996 | Hoffman | 160/183 |
| 5,592,787 A | * | 1/1997 | Ophardt | 52/34 |
| 5,685,113 A | * | 11/1997 | Reuter et al. | 52/220.7 |
| 5,941,104 A | * | 8/1999 | Sadler | 292/216 |
| 6,199,922 B1 | * | 3/2001 | Kibble | 292/140 |

FOREIGN PATENT DOCUMENTS

| | | |
|---|---|---|
| AU | 545 891 | 8/1985 |
| DE | 69 02 904 | 2/1971 |
| DE | 87 13 007 | 2/1988 |
| DE | 40 09 764 | 10/1990 |
| DE | 44 45 383 | 8/1996 |
| DE | 196 37 453 | 11/1997 |
| DE | 297 05 977 | 11/1998 |
| DE | 297 10 853 | 12/1998 |
| EP | 0 851 081 | 7/1998 |
| FR | 551 489 | 4/1923 |
| FR | 908 329 | 4/1946 |
| FR | 921 069 | 5/1947 |

* cited by examiner

*Primary Examiner*—Anthony Knight
*Assistant Examiner*—Christopher Boswell
(74) *Attorney, Agent, or Firm*—Reed Smith LLP

(57) ABSTRACT

The description relates to a latch closure for walls, doors, shutters which are articulated at frames, housings or the like by hinges, wherein the frame surfaces, housing surfaces, door surfaces or wall surfaces which are connected with one another by the hinges are essentially flush with one another in the closed position, comprising a first closure housing which can be fastened to the frame or the like and which has a rear-engagement portion for receiving the latch of the latch closure in a locking manner and a second closure housing which can be fastened to the door or the like and in which the latch is arranged so as to be displaceable against spring force by means of a handle, wherein, according to the invention, the second closure housing forms a projection which contacts an end face formed by the first closure housing essentially parallel to the door plane when the door is closed.

17 Claims, 8 Drawing Sheets

LATCH CLOSURE

BACKGROUND OF THE INVENTION a) Field of the Invention

The invention is directed to a latch closure for walls, doors and shutters which are articulated at frames, housings or the like by hinges, wherein the frame surfaces, housing surfaces, door surfaces or wall surfaces which are connected with one another by the hinges are essentially flush with one another toward the outside in the closed position, comprising a first closure housing which can be fastened to the frame or the like and which has a rear-engagement portion for receiving the latch of the latch closure in a locking manner and a second closure housing which can be fastened to the door or the like and in which the latch is arranged so as to be displaceable against spring force by means of a handle.

b) Description of the Related Art

Room door closures are usually latch closures but are installed inside the door leaf. Formerly, it was often common to attach such latch closures to the door leaf also.

Particularly in the latter case, the latch is accessible through the gap remaining when the door is closed and it is possible to push the latch back with a suitable tool such as a screwdriver and to open the door even when the actual actuating device that should draw back the latch is locked. This is a substantial disadvantage in the known latch closures and is particularly troublesome in connection with doors of switching cabinets whose interior must be protected against tampering or whose interior poses a danger to unauthorized persons.

OBJECT AND SUMMARY OF THE INVENTION

It is the primary object of the invention to improve the latch closure of the type mentioned above in such a way that the latch is better protected from attempts at tampering and in particular it is made more difficult to push the latch back with a screwdriver or similar tool.

In certain applications, for example, simply constructed housings which are to be closed by a shutter, a stop at the door leaf or at the shutter or housing is omitted, so that it is difficult under certain circumstances to bring the door into the position in which the closure locks neatly. Therefore, a further object consists in providing, in these cases, a stop for the door or shutter in the closed position which is not formed by the door or the housing itself, but by the closure.

This object is met in that the second closure housing in the latch closure of the type mentioned in the beginning forms a projection which contacts an end face formed by the first closure housing essentially parallel to the door plane when the door is closed.

By means of this step, the gap formed between the two closure housing parts of the closure is closed toward the outside in such a way that it is no longer possible to penetrate without difficulty between the two closure housing parts, for example, with a screwdriver, and to pry them apart and, in some cases, even push the latch out of its closed position.

Further, it is possible by means of this projection to realize a stop function which functions independent from the door leaf or door frame and forms a stop for the door in the closed position. The advantage of this stop—compared with stops that are formed by the door leaf or the door frame itself—is that it enables a more precise position of the stop with respect to the latch and accordingly also prevents the door from rattling when there is play between the other stops, for example, due to inexact dimensioning of the stops or warping of the door or frame.

Additional protection against tampering by prying apart the closure parts is achieved when a groove which extends parallel to the frame is formed in the end face and when a spring or strip which can be fitted into the groove projects from the projection.

For a good frictional engagement, it is advantageous when the rear-engaging surface formed by the first closure housing for receiving the latch lies below the end face and parallel to it according to a further development of the invention.

In case the outer surface of the door and frame are not exactly aligned relative to one another, it may be advantageous to provide a spacer plate which compensates for this difference in distance.

The latch closure according to the invention is particularly advantageous when the frame or the like and the outer contour of the door or the like are formed by profile pieces outfitted with undercut grooves. A further development of this embodiment form is characterized in that the two closure housings likewise have undercut grooves in their mounting surfaces; however, these undercut grooves preferably extend vertical to the profile axis and accordingly enable a favorable adjustability, e.g., even with profiles of different width. Other fastening possibilities, which may be adjustable as the case may be, are threaded bore holes arranged in the fastening surface in an offset manner in a grid (according to given profile widths) or fastening tabs at the sides of the closure housings which have a round opening or an elongated hole extending transverse to the profile axis, optionally with locking ribbing. The lever for opening the closure is preferably mounted so as to be swivelable about an axis extending parallel to the stop surface and at the height of the shoulder. This shortens the acting lever arm and accordingly increases the stability of the arrangement. The movement path of the handle can be limited by a protuberance which is formed, for example, by a cylinder lock. It is possible to lock into the closure in this way.

BRIEF DESCRIPTION OF THE DRAWINGS

The invention is explained more fully with reference to embodiment examples which are shown in the drawings.

FIGS. 14A, 15B and 14C show three further views of the first hinge housing part of the latch closure according to the invention;

FIG. 1 shows a side view of a latch closure 10 comprising a first closure housing 12 with rear-engagement 14 for receiving the latch 16 of the latch closure which is arranged in a second closure housing 18 so as to be displaceable against the force of a spring by means of a handle 58. In this case, the first housing 12 is mounted on a profile piece 20 having a rectangular cross section and an undercut groove 22 on each of its four side faces. Frames, housings arid similar devices can be composed of such profiles; for example, the profile 20 is part of a frame at which a door is articulated by means of hinges. Therefore, profile piece 24 in FIG. 1 can be viewed as a component part of a door which can be swiveled in the direction of arrow 26 to open. According to FIG. 1, the second housing 18 is fastened to this profile piece 24 forming the closure side of the door. In order to fasten the housing 12 or 18 to the frame 20 or door 24, the base surface 28 or 30 of the first housing 12 or second housing 18 can be glued, screwed or welded to the corresponding outer surface of the frame 20 or door 24. However, the type of fastening selected in this case, in which undercut transverse grooves 32 are introduced into the rear side 28 of the first closure hosing 12, is particularly favorable; nuts and sliding or groove blocks 34 (FIGS. 6A, 6B) which are shaped by one side so as to fit in can be inserted into the transverse grooves 32, wherein a fastening pin 36 which is guided through the profile piece 20, but inserted through the wall of a housing or crosspiece of a fame in other applications, can be screwed into the groove block or nut 34. Pins or bolts 36 accordingly clamp the housing 12 to the profile piece 20 or to the frame by means of the groove block or nut 34. FIG. 14A shows that the undersurface 28 of the housing 12 forms two undercut grooves 32 opening toward one end in such a way that it is possible to carry out adjustable mounting vertical to the profile piece extension so as to be fixed with respect to relative rotation.

In a corresponding manner, according to FIG. 1, the second housing 18 is fastened by means of screw bolts and a groove block; in FIG. 17A, see the undercut grooves 132 which are again open on one side. Due to the fact that these undercut grooves 132 and 32 extend transverse to the axis of the profile pieces 20, 24, it is possible to adjust the distance between the two housings 12, 18 and accordingly to adapt to the spacing 38 between the two profile pieces and therefore also to align the housing with the profile pieces. In the same way, it is possible to adapt to profiles (usually center-drilled) with different widths (which are delivered, for example, with a width of 25 . . . 50 mm provided in increments of 5 mm).

Figure 18:
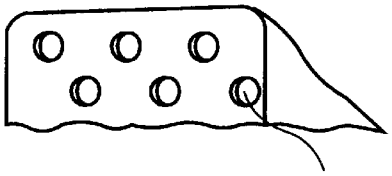
FIG. 18 shows a partial view of the fastening surface of one closure housing with threaded bore holes arranged in an offset manner.
Figure 17C:
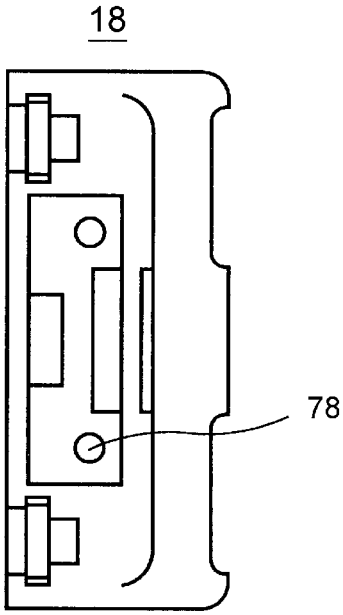

Alternatively, the rear side or fastening surface of the closure housing can be provided with threaded bore holes 133 (FIG. 18) which are arranged in an offset manner, e.g., in the 5 mm grid of deliverable profile widths.

Figure 2:
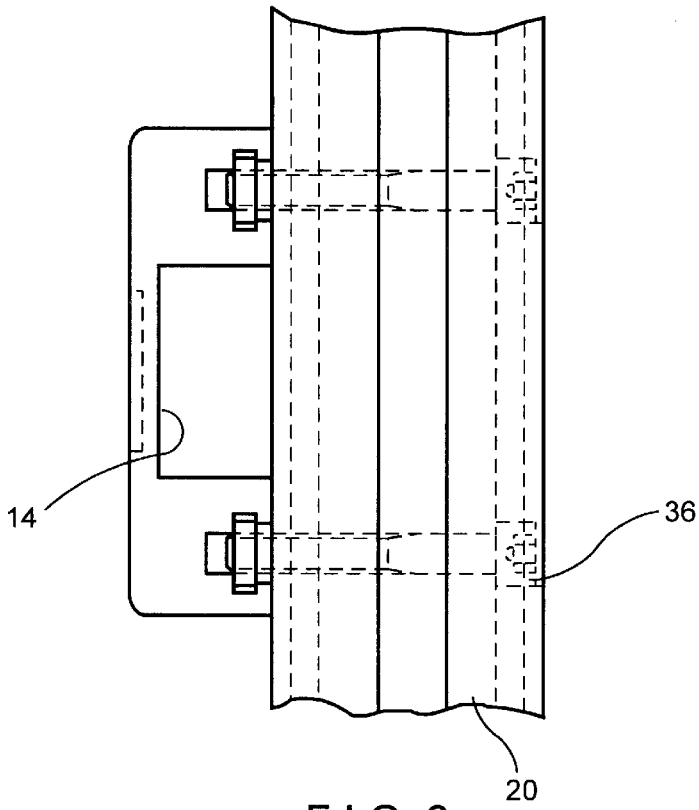
FIG. 2 is a view from below of the upper (first) hinge housing part according to FIG. 1 with associated profile piece.
Figure 1:
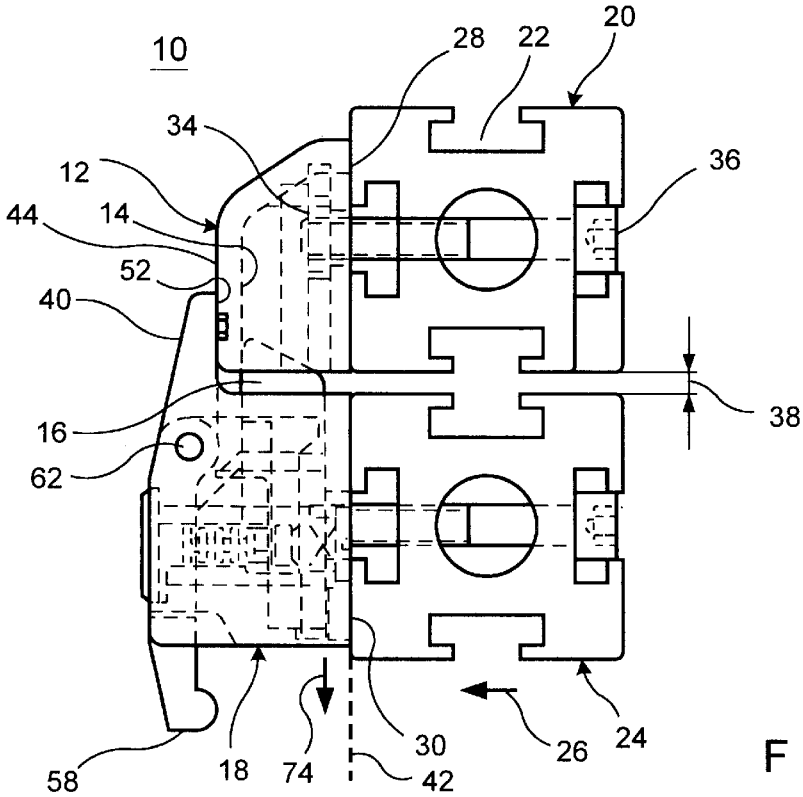
FIG. 1 is a side view showing a latch closure which is constructed according to the invention and mounted on two profiles which form part of the frame or part of the door and have undercut grooves.

The gap 38 is bridged by a projection 40 which is formed by the second housing 18 and which, when the door is closed as is shown in FIG. 1, lies on an end face 44 which is formed by the first housing 12 and which extends essentially parallel to the door plane 42. The rear-engaging surface 14 formed by the first housing 12 for receiving the tongue 16 lies below this end face 44 and parallel to it with respect to the projection 40 as can be seen in FIG. 1.

The wall area of the first closure housing 12 lying between surfaces 14 and 44 is accordingly fixed substantially without play between the projection 40 and the latch 16. This prevents the door from rattling in the closed state and, at the same time, the projection 40 forms a stop for the door 24 at the door frame 20, specifically in that the projection 40 stops against the end face 44.

Figure 3:
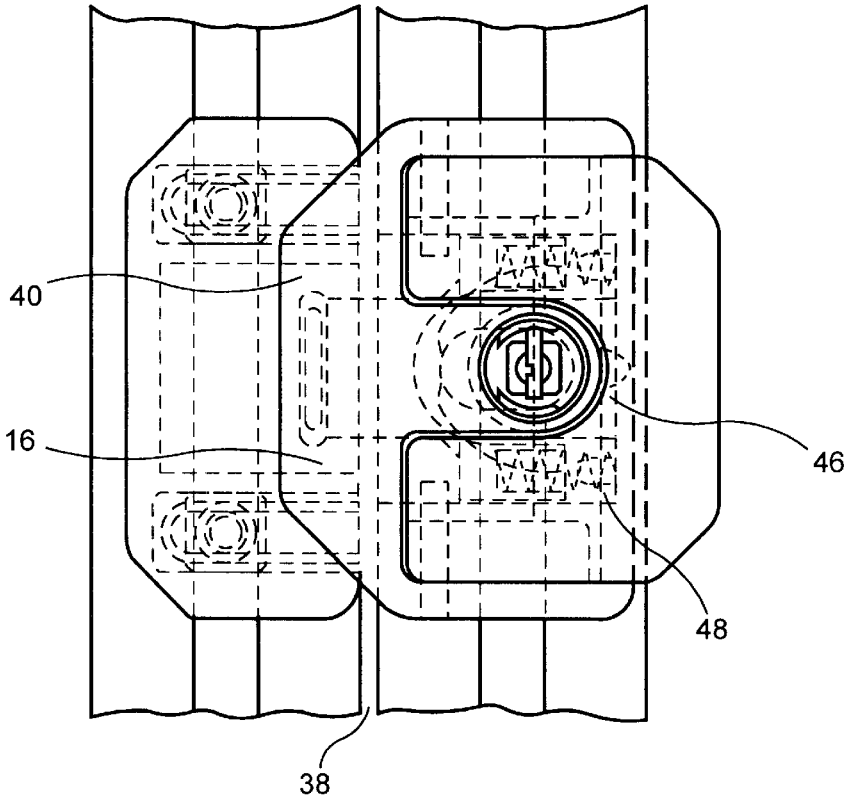
FIG. 3 is a top view of the arrangement according to FIG. 1 with unlocked closure.
Figure 4:
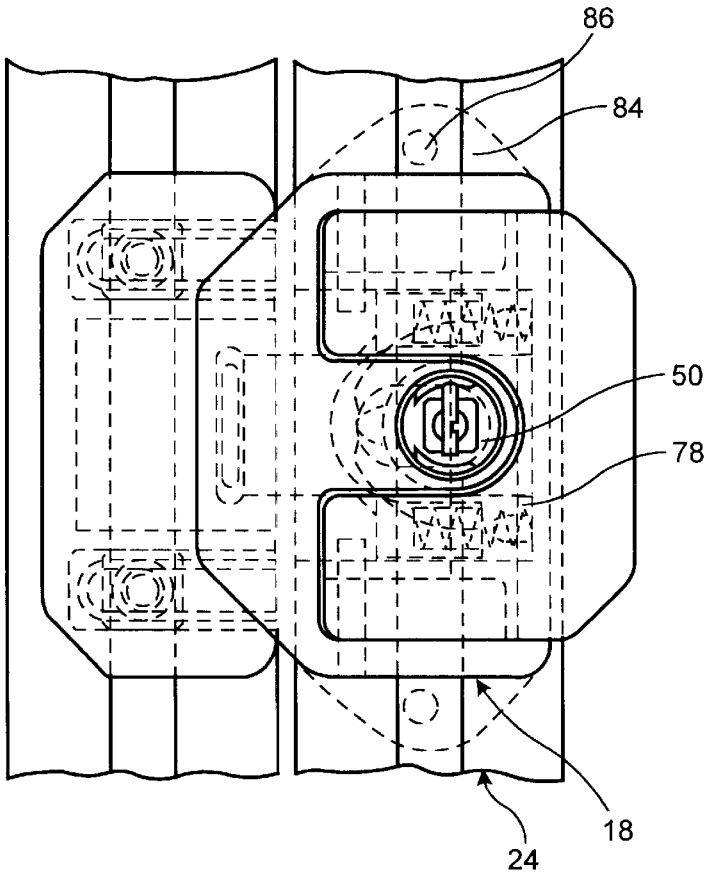
FIG. 4 shows a view similar to FIG. 3, but with locked closure and alternative fastening possibility.
Figure 5:
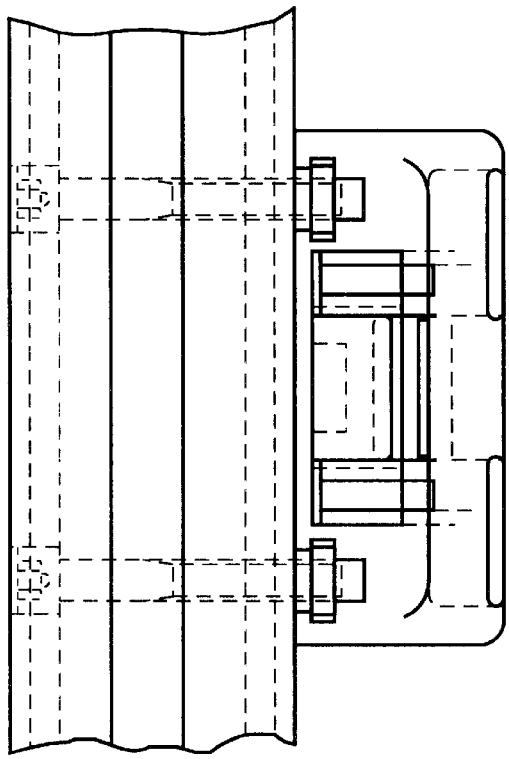
FIG. 5 shows a top view of the lower (second) hinge housing part of FIG. 1.
Figure 6A:
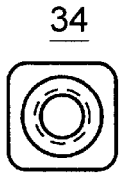
FIGS. 6A and 6B show a top view and a side view of a nut (groove block) used for fastening.
Figure 7A:
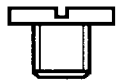
FIGS. 7A and 7B are a side view and top view of a screw used for fastening a locking protuberance (FIG. 10)
Figure 8:
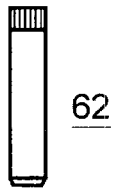
FIG. 8 shows a side view of a shaft pin.
Figure 6B:
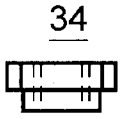
Figure 7B:
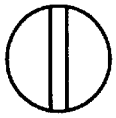

Further, the projection 40 conceals the tongue 16 along its entire width, so that this tongue cannot be pushed back by inserting a tool into the gap 38 (see FIG. 3), even when, as is shown in FIG. 3, the protuberance 46 does not prevent it from being set back against the force of the springs 48, so that it is possible for the door to be closed while, at the same time, the latch 16 is set back against the force of the spring. FIG. 4 shows the locked position of the latch in which a structural component part which is placed on the square of this cylinder lock and which forms the protuberance 46 and is shown in different views in FIGS. 10A, 10B, 10C and 10D is rotated into the position shown in FIG. 4 by a cylinder lock 50 so as to prevent a displacement of the tongue shown in FIGS. 9A, 9B, 9C and 9D, wherein the protruding structural component part 46 may be fixed to the shaft of the cylinder lock by means of a head screw shown in FIGS. 7A and 7B.

Figure 14A:
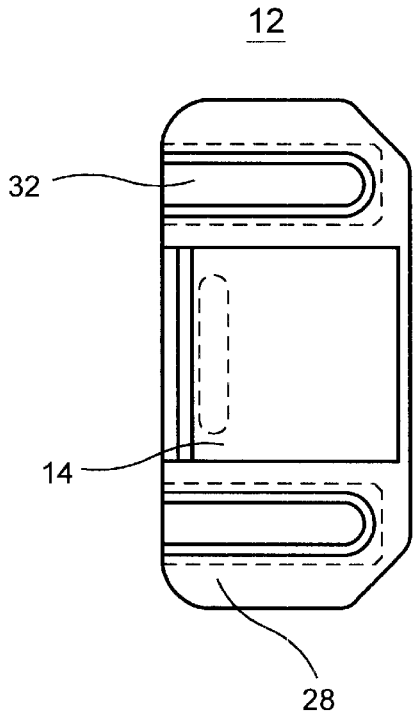
Figure 14B:
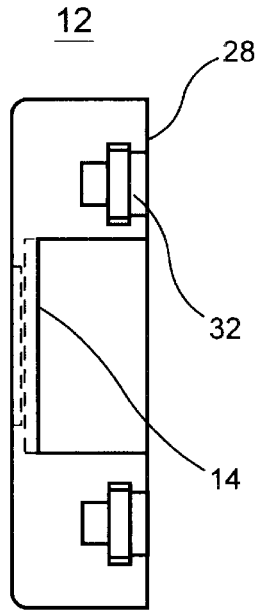
Figure 14C:
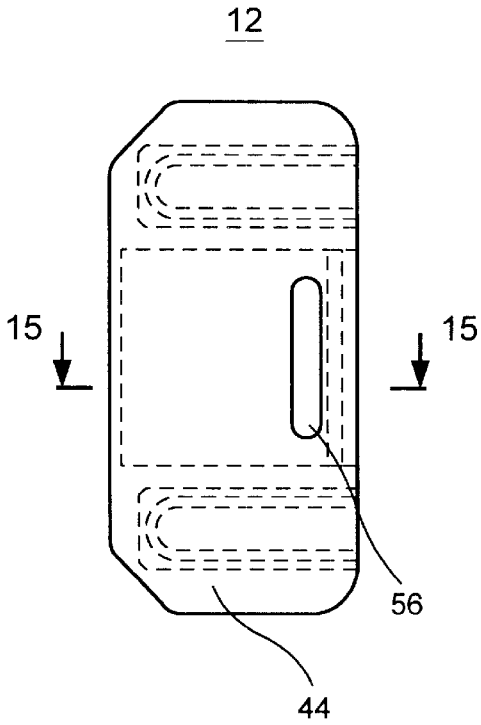
Figure 15:
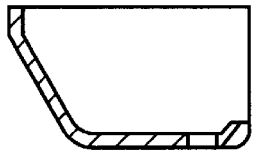
FIG. 15 shows a sectional view along line A—A of FIG. 14C.

An elongated spring or strip 54 projects from the support surface 52 of the projection 40 of the second housing 18 and can be received in an elongated recess 56 (see FIG. 14*c*) formed by the end face 44 of the first closure housing 12, in order to provide for additional protection against the two housing parts 18, 12 being pushed apart when they are in the closed position shown in FIG. 1.

It is not until the latch 16 is pulled back from the rear-engaging surface 14 by actuating a handle lever 58 that the surface 52 of the projection 40 can be distanced from the surface 44 of the housing 12 and accordingly the projection 54 can also move out of the recess 56. The tongue 16 and projection/recess (groove spring) (54, 56) accordingly form a very secure connection between the two closure housings 12, 18 and a strong resistance to unauthorized tampering.

Figure 16A:
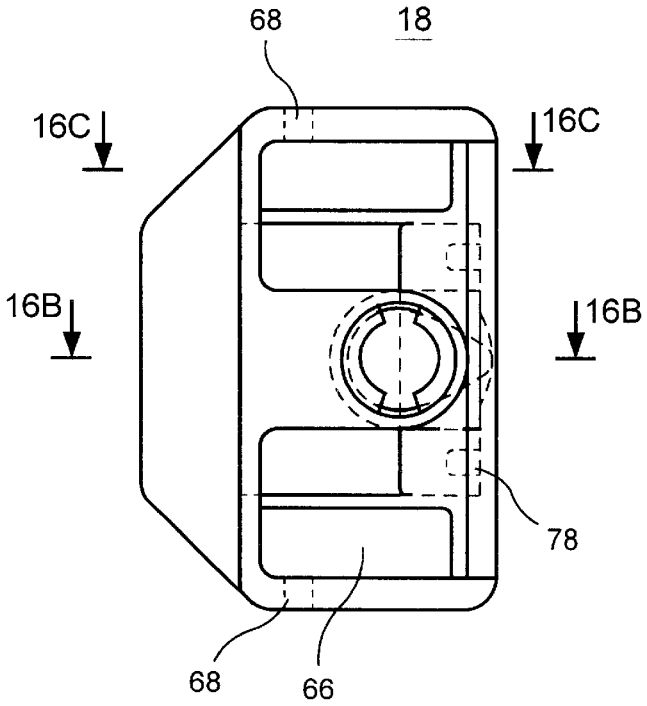
FIGS. 16A, 16B, 16C, 16D, 17A, 17B, 17C show additional views of the second hinge housing part of the latch closure according to the invention.

The hand lever 58 which was already mentioned is shown in more detail in FIGS. 11A, 11B, 11C, 11D and 12, 13. It is formed of a metal or plastic injection molded part and has two laterally open axial bore holes 76 in which an axial pin 62 can be received after the two legs 64 of the fork-shaped hand lever 58 have been received in corresponding receptacles 66 of the housing 18 (see FIG. 16A). Two axial pins 62 which are inserted through bore holes 68 of the housing 18 and are received in the pocket bore holes 60 of the hand lever 58 accordingly enable a swiveling of the hand lever 58,with respect to the housing 18, wherein as a result of this swiveling two shoulders 66, 70 proceeding from the hand lever 58 press against stop faces 72 which are formed by the latch 16 according to FIG. 9A. The latch 16 is displaced by this pressure in the direction of arrow 74 and accordingly presses two springs 48 (FIG. 3) together, which springs 48 are received in pocket bore holes 76 of the latch 16 on the one hand and are supported on projections 78 on the other hand which are formed by the second housing 18 and shown in FIGS. 16A and 16B.

Figure 9A:
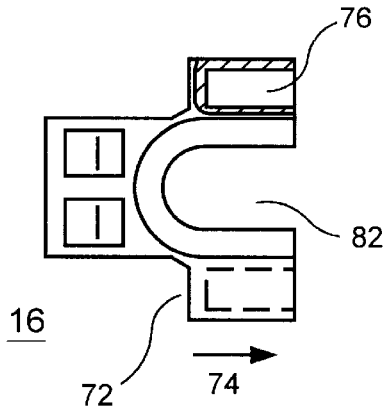
FIGS. 9A, 9B, 9C and 9D show four different views of the latch of the latch closure.
Figure 9B:
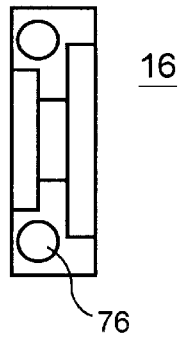
Figure 9C:
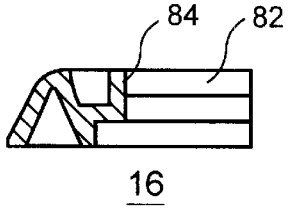
Figure 9D:
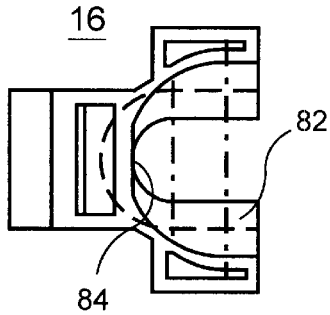
Figure 10A:
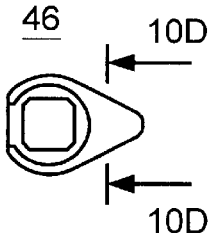
FIGS. 10A, 10B, 10C and 10D show different views of the locking protuberance for locking the latch.
Figure 10B:
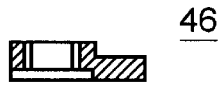
Figure 10C:
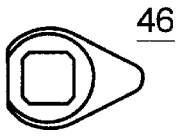
Figure 10D:
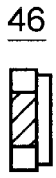
Figure 12:
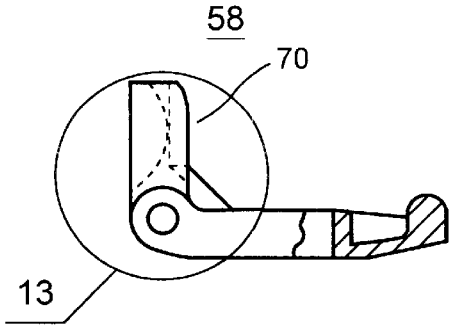
FIG. 12 shows a detailed view of the handle to illustrate its articulation.
Figure 13:
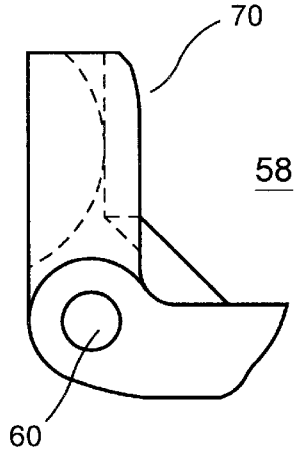
FIG. 13 shows an enlarged view of the articulated area.
Figure 11A:
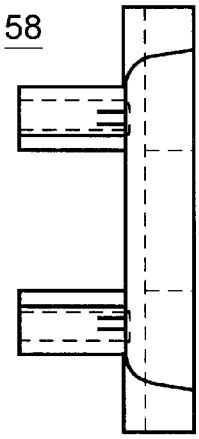
FIGS. 11A, 11B, 11C and 11D show different views of the handle of the latch closure according to the invention.
Figure 11B:
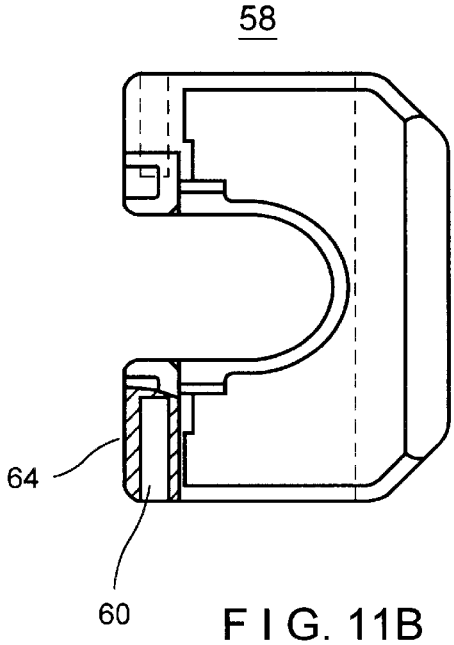
Figure 11C:
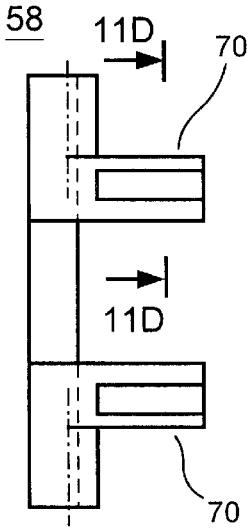
Figure 11D:
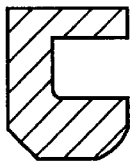
Figure 16B:
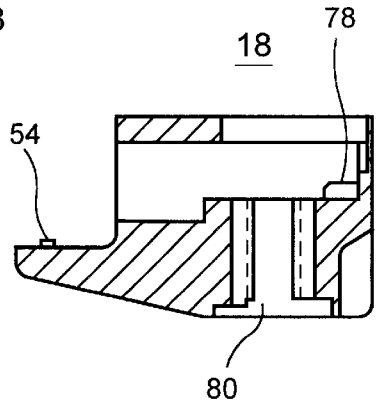
Figure 16C:
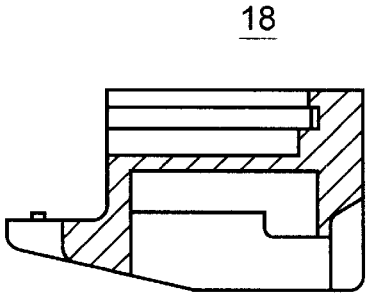
Figure 16D:
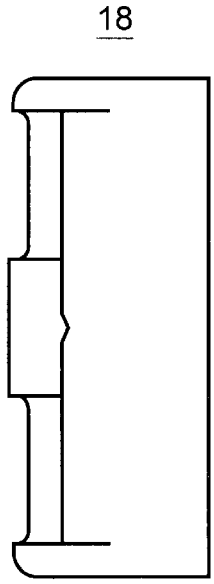
Figure 17A:
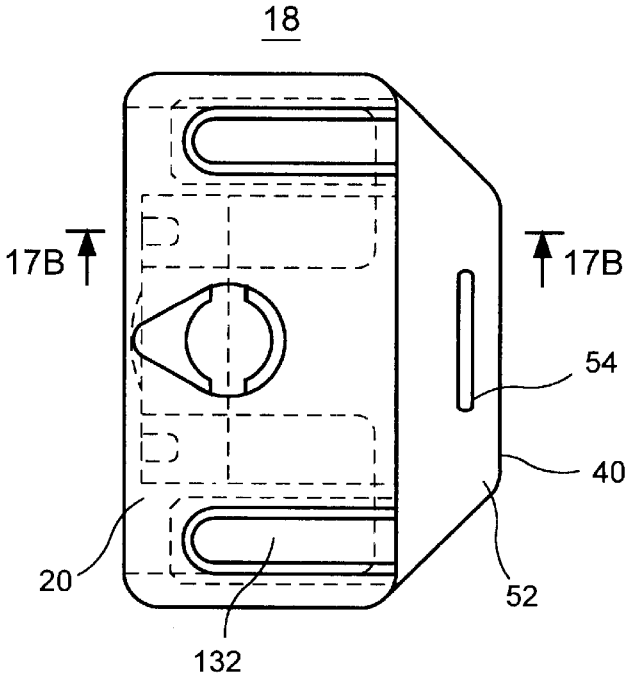
Figure 17B:
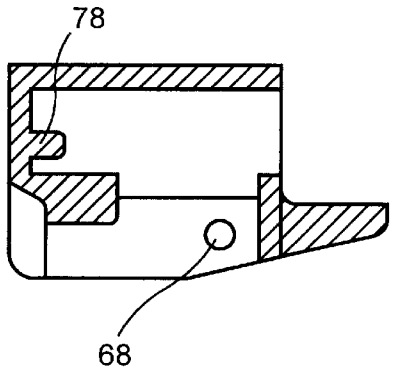

The sectional view according to FIG. 16B of the second housing 18 also shows an opening 80 in which a lock cylinder can be received, the above-mentioned protuberance device 46 which is received in the space 82 formed by the latch 16 according to FIG. 9A and abuts at 84 when the cylinder lock is located in the locked position indicated in FIG. 4 is arranged at the inner end of the lock cylinder.

Further, FIG. 4 shows another possible form of the fastening, namely, by means of projecting plate parts 84 with pocket bore holes or through-bore holes 86 through which fastening screws are inserted and which enable a fastening of the second housing part 18 at the frame or door leaf 24.

Figure 19:
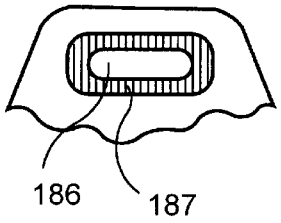
FIG. 19 shows a partial view of a fastening tab with ribbed elongated hole.
Figure 20:
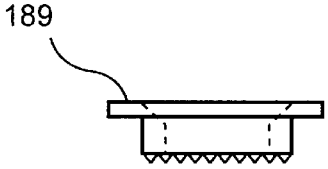
FIG. 20 is a side view of a matching bushing for receiving the head of a fastening screw.

Alternatively, an elongated hole 186 (FIG. 19) aligned vertical to the profile axis can also be provided instead of the round bore hole 186; this elongated hole 186 again makes possible a displacement of the respective closure housing 18 with respect to the profile 12 in order to adjust the housing—also with different profile widths (profiles of the type described herein have widths of, e.g., 25 to 50 mm delivered in increments of 5 mm)—in such a way that it is flush with the profile as is shown in FIG. 1 (gap 38). The plate with the round bore hole 86 or elongated hole 186 makes it possible to use a fastening pin with a sliding block which is inserted into a profile groove 22; it is not necessary to drill through the profile in order to insert a fastening pin 36 (FIG. 1). This results in an adjustable fastening which can nevertheless be favorably protected against displacement by tightening the screw. However, if the screw heads are accessible from the outside, the same protection against tampering as that afforded by inaccessible screw bolts according to FIG. 1 or FIG. 18 cannot be achieved. Alternatively, a bushing with ribbing and internal thread into which a screw bolt is screwed can also be used.

The invention can be applied commercially in switching cabinet construction among other areas.

While the foregoing description and drawings represent the present invention, it will be obvious to those skilled in the art that various changes may be made therein without departing from the true spirit and scope of the present invention.

What is claimed is:

1. A latch closure for walls, doors and shutters which are articulated at frames, or housings by hinges, wherein the Same surfaces, housing surfaces, door surfaces, shutter surfaces or wall surfaces which are connected with one another by the hinges are essentially flush with one another toward the outside in the closed position, comprising:

a first closure housing which can be fastened to the frame or the housing and which has a rear-engagement portion for receiving the latch of the latch closure in a locking manner;

a second closure housing which can be fastened to the door and in which the latch is arranged so as to be displaceable against spring force by a handle;

said second closure housing forming a projection which contacts an end face formed by the first closure housing essentially parallel to the door plane when the door is closed;

said end face having a notch or a groove which extends parallel to the extension of the frame;

a strip which can be received in the groove projecting from the projection; and said first and said second closure housings having, in mounting surface, undercut grooves or threaded bore holes or fastening tabs;

wherein the frame and the outer contour of the door are formed by profile pieces which are outfitted with undercut grooves.

2. The latch closure according to claim 1, wherein the rear-engaging portion formed by the first closure housing for receiving the latch lies below the end face and parallel to it.

3. The latch closure according to claim 1, wherein a spacer plate is optionally provided between the outer surface of the door or frame and a housing mounted thereon.

4. The latch closure according to claim 1, wherein the frame or the like and the outer contour of the door or the like are formed by profile pieces which are outfitted with undercut grooves.

5. A latch closure for walls, doors and shutters which are articulated at frames, or housings by hinges, wherein the frame surfaces, housing surfaces, door surfaces, shutter surfaces or wall surfaces which are connected with one another by the hinges are essentially flush with one another toward the outside in the closed position, comprising:

a first closure housing which can be fastened to the frame or the housing and which has a rear-engagement portion for receiving the latch of the latch closure in a locking manner;

a second closure housing which can be fastened to the door and in which the latch is arranged so as to be displaceable against spring force by a handle;

said second closure housing forming a projection which contacts an end face formed by the first closure housing essentially parallel to the door plane when the door is closed;

said end face having a notch or a groove which extends parallel to the extension of the frame;

a strip which can be received in the groove projecting from the projection; and said first and second closure housings having, in mounting surface, undercut grooves or threaded bore holes or fastening tabs; and wherein the grooves of the two closure housings extend vertical to the profile axis.

6. The latch closure according to claim 1, wherein the two closure housings have, in their mounting surfaces, threaded bore holes which are arranged in an offset manner in a predetermined grid so as to be adapted to different profile widths.

7. The latch closure according to claim 1, wherein the two closure housings have fastening tabs which have a round opening or elongated hole, wherein the elongated hole extends vertical to the profile axis and is provided with an edge with transverse ribbing for receiving a bushing with matching ribbing receiving the head or the thread of the fastening screw in order to lock the position of the closure housing with respect to the profile edge.

8. A latch closure for walls, doors and shutters which are articulated at frames, or housings by hinges, wherein the frame surfaces, housing surfaces, door surfaces, shutter surfaces or wall surfaces which are connected with one another by the hinges are essentially flush with one another toward the outside in the closed position, comprising:

a first closure housing which can be fastened to the frame or the housing and which has a rear-engagement portion for receiving the latch of the latch closure in a locking manner;

a second closure housing which can be fastened to the door and in which the latch is arranged so as to be displaceable against spring force by a handle;

said second closure housing forming a projection which contacts an end face formed by the first closure housing essentially parallel to the door plane when the door is closed;

said end face having a notch or a groove which extends parallel to the extension of the frame;

a strip which can be received in the groove projecting from the projection; and said first and second closure housings having, in mounting surface, undercut grooves or threaded bore holes or fastening tabs;

wherein a hand lever is mounted so as to be swivelable about an axis which is parallel to the stop surface and at the height of the shoulder.

9. The latch closure according to claim 1, wherein the movement path of the handle is limited by a stop protuberance on a cylinder lock.

10. The latch closure according to claim 8, wherein the rear-engaging portion formed by the first closure housing for receiving the latch lies below the end face and parallel to it.

11. The latch closure according to claim 8, wherein a spacer plate is optionally provided between the outer surface of the door or frame and a housing mounted thereon.

12. The latch closure according to claim 8, wherein the frame or the like and the outer contour of the door or the like are formed by profile pieces which are outfitted with undercut grooves.

13. The latch closure according to claim 8, wherein the grooves of the two closure housings extend vertical to the profile axis.

14. The latch closure according to claim 8, wherein the two closure housings have, in their mounting surfaces, threaded bore holes which are arranged in an offset manner in a predetermined grid so as to be adapted to different profile widths.

15. The latch closure according to claim 8, wherein the two closure housings have fastening tabs which have a round opening or elongated hole, wherein the elongated hole extends vertical to the profile axis and is provided with an edge with transverse ribbing for receiving a bushing with matching ribbing receiving the head or the thread of the fastening screw in order to lock the position of the closure housing with respect to the profile edge.

16. The latch closure according to claim 8, wherein the hand lever is mounted so as to be swivelable about an axis which is parallel to the stop surface and at the height of the shoulder.

17. The latch closure according to claim 8, wherein the movement path of the handle is limited by a stop protuberance on a cylinder lock.

* * * * *